United States Patent [19]

Paddock

[11] Patent Number: 4,681,387

[45] Date of Patent: Jul. 21, 1987

[54] LATCH CONNECTOR

[75] Inventor: Albert W. Paddock, Huntington Beach, Calif.

[73] Assignee: The United States of America as represented by the Secretary of the Army, Washington, D.C.

[21] Appl. No.: 933,430

[22] Filed: Nov. 21, 1986

[51] Int. Cl.[4] ..... H01R 13/633

[52] U.S. Cl. ..... 439/347; 439/160

[58] Field of Search ..... 339/45 R, 45 M, 91 R

[56] References Cited

U.S. PATENT DOCUMENTS 4,057,879 11/1977 Eigenbrode ..... 339/91 R
4,168,877 9/1979 Little et al. ..... 339/91 R
4,447,102 5/1984 Kourimsky et al. ..... 339/91 R
4,526,431 7/1985 Kasukawa ..... 339/91 R

FOREIGN PATENT DOCUMENTS 0116426 8/1984 European Pat. Off. ..... 339/45 M

*Primary Examiner*—John McQuade
*Attorney, Agent, or Firm*—John C. Garvin, Jr.; Freddie M. Bush

[57] ABSTRACT

A latch connector for releasably connecting a male connector provided with plural male terminals and a female connector provided with plural female terminals. The connector includes a handle member cooperating with the latch member to effect disconnection of a pair of electrical connectors.

3 Claims, 6 Drawing Figures

LATCH CONNECTOR

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

Electrical connectors typically consist of a small connector having a plurality of male terminals disposed for insertion into a plurality of female terminals of a female connector. In some cases the frictional engagement between the male and female connectors are relied upon for maintaining secured relation of the connectors. This has proven to be unsatisfactory when the connectors are used in environments where shock, vibration, or acceleration could cause them to separate, as in a missile system. Other types of connectors include a lever mechanism built into the male coupling at opposite ends thereof and engageable with indentations built into the surface of the female member for retention of the male and female members in secured relation. Such connectors necessarily require complicated manufacturing processes in that the lever mechanism must be built into the male connector at manufacture as must the indentations of the female connector.

It is therefore, an object of the present invention to provide a latch connector for releasably mating standard male and female electrical connectors for retention thereof during extreme accelerations or vibrations.

It is a further object of the present invention to provide such a latch connector as an adjunct assembly for standard connectors and thus eliminate the need for the latch connector to be made a part of the male or female connectors during manufacture thereof.

DESCRIPTION OF THE PREFERRED EMBODIMENT

Figure 1:
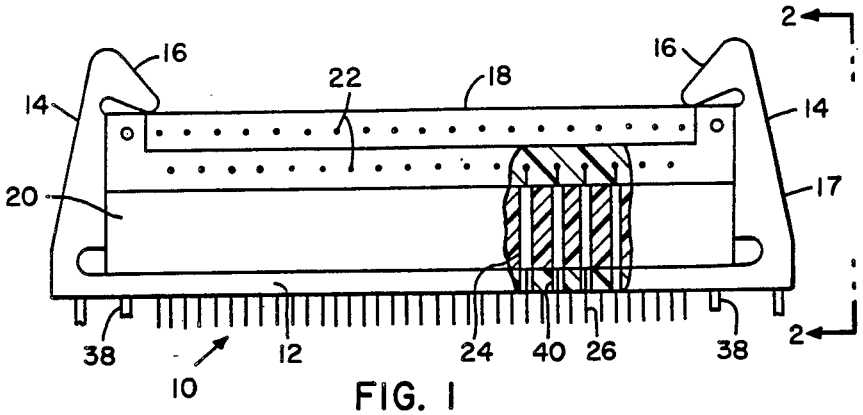
FIG. 1 is an elevational partial sectional view of the latch connector disposed for retention of male and female electrical connectors in secured relation.

As seen in FIG. 1 a latch connector assembly 10 includes a base portion 12 having a pair of upwardly extending latch portions 14 terminating in a pair of latch hooks 16 in engagement with a male electrical connector 18 for maintaining a secured relation between the male connector and a female electrical connector 20. The connectors are standard electrical connectors and the male connectors include extending pin conductors 22 and the female connector includes receptacles 24 having pin conductors 26 extending therefrom.

Figure 2:
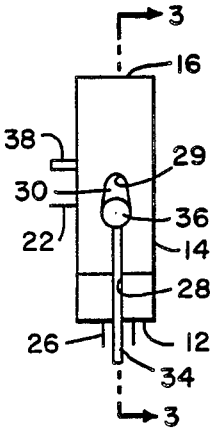
FIG. 2 is an end elevational view taken along line 2—2 of FIG. 1.
Figure 3:
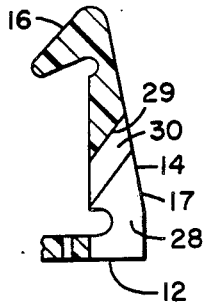
FIG. 3 is a sectional view taken along line 3—3 of FIG. 2 with the unlatching handle omitted for clarity.
Figure 4:
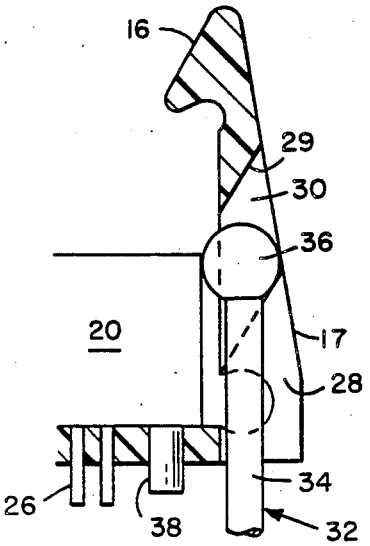
FIGS. 4, 5 and 6 are elevational views, partially in section, graphically illustrating the latch connector of the present invention, respectively, in unmated, mating-/unmating, and latched positions.
Figure 5:
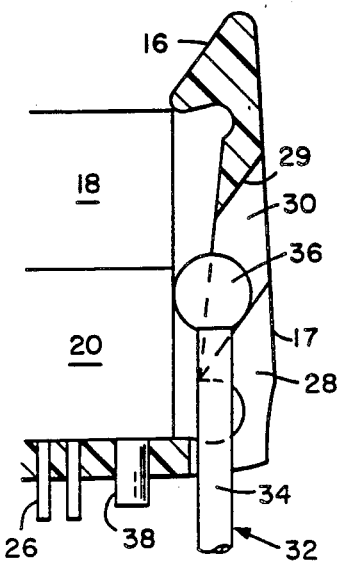

As seen in FIGS. 2 and 3 the upwardly extending portion 14 of the latch is provided with a groove 28 extending upwardly from base portion 12 and terminating between the hook portion 16 and base portion 12. The outer surface 17 of portion 14 is angled inwardly from the base to the hook portion. An angled circular opening 30 is provided at the upper end 29 of groove 28. A handle 32 which includes a shaft portion 34 and ball ends 36 (FIGS. 4, 5 and 6) is positioned in groove 28 and circular opening 30 to provide for release of the latch member so that the connector bodies can be separated. Both the latch and the handle consists of molded plastic.

Figure 6:
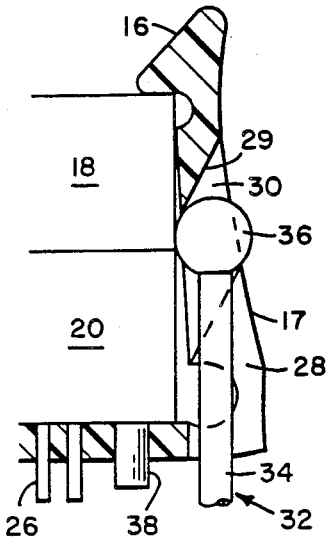

In operation the latch assembly 10 is attached to the connector using the connector mounting rivets 38 with the pins 26 of the bottom connector (female) 20 extending through mating openings 40 in the base portion 12 of the latch. A ball end 36 of handle 32 is inserted in opening 30 and groove 28 of latch portion 14 prior to mating the base portion 12 to connector body 20. As the connectors 18 and 20 are mated, the latch hook portions 16 cams on the connector body 18, flex outwardly (because of the resiliency of portion 14) and then snap into engagement with the upper surface of the connector 18. (FIG. 6).

Unmating the connectors is accomplished (FIGS. 4 and 5) by pulling on handle 32, causing its ball end 36 to cam on the connector and on the latch grooves 28 forcing the upwardly extending latch portions 14 away from the connector bodies to flex the hook portions 16 away from the upper connector.

I claim:

1. A latch connector for releasably securing a pair of electrical connectors together comprising:

a. a latch connector body including a base portion having holes therein for receiving pin conductors of a first of said pair of connectors therethrough;

b. a pair of upstanding end latch portions extending from said base portion and having hook portions at the distal ends thereof for engagement with the second of said pair of connectors for retention of said connectors in secured relation;

c. said end latch portions having a groove therethrough extending from said base portion and terminating intermediate said base portion and said hook portion, and, an angled circular opening extending transversely through said end latch portions and in communication with said groove; and d. unlatching means disposed in each of said angled circular openings and cooperating with said upstanding end latch portions to effect disconnection of said latch connector from said second of said pair of electrical connectors, by flexing said end latch portions for release of said hook portions from said second of said pair of connectors.

2. A device as in claim 1 wherein each said unlatching means includes a handle member having an end portion in the shape of a ball and a shaft portion extending therefrom each said ball disposed in a respective circular opening for movement down said groove to provide for flexing of said end latch portions and release of said hook portions from said second of said pair of connectors responsive to application of a pulling force on said handle members of said unlatching means.

3. A device as in claim 2 wherein said latch connector and said handle member is plastic.

* * * * *